US010792792B2

(12) United States Patent
Hsieh

(10) Patent No.: US 10,792,792 B2
(45) **Date of Patent: *Oct. 6, 2020**

(54) WRENCH WITH QUICKLY ANGULARLY ADJUSTABLE HANDLE

(71) Applicant: KABO TOOL COMPANY, Taichung (TW)

(72) Inventor: Chih-Ching Hsieh, Taichung (TW)

(73) Assignee: KABO TOOL COMPANY, Taichung (TW)

( * ) Notice: Subject to any disclaimer, the term of this patent is extended or adjusted under 35 U.S.C. 154(b) by 196 days.

This patent is subject to a terminal disclaimer.

(21) Appl. No.: 15/603,221

(22) Filed: May 23, 2017

(65) Prior Publication Data

US 2017/0252907 A1 Sep. 7, 2017

Related U.S. Application Data

(63) Continuation of application No. 14/160,341, filed on Jan. 21, 2014, now Pat. No. 9,700,998.

(51) Int. Cl.

| | |
|---|---|
| ***B25B 23/00*** | (2006.01) |
| ***B25G 1/06*** | (2006.01) |
| ***B25B 13/04*** | (2006.01) |
| ***B25B 13/08*** | (2006.01) |

(52) U.S. Cl.

CPC ..... *B25B 23/0028* (2013.01); *B25B 13/04* (2013.01); *B25B 13/08* (2013.01); *B25G 1/063* (2013.01)

(58) Field of Classification Search

CPC ..... B25B 23/0028; B25B 13/04; B25B 13/08; B25G 1/063

USPC ..... 81/177.9

See application file for complete search history.

(56) References Cited

U.S. PATENT DOCUMENTS

| | | | | | |
|---|---|---|---|---|---|
| 777,955 | A | * | 12/1904 | Kanning | B25B 13/481 81/177.8 |
| 1,597,939 | A | * | 8/1926 | Wermes | B25B 13/481 81/177.7 |
| 3,023,652 | A | * | 3/1962 | Feldman | B25B 13/462 81/3.44 |
| 3,068,728 | A | * | 12/1962 | Shepherd | B25B 23/0021 403/79 |

* cited by examiner

*Primary Examiner* — Hadi Shakeri
(74) *Attorney, Agent, or Firm* — Guice Patents PLLC

(57) ABSTRACT

A wrench with quickly angularly adjustable handle includes a head section and a handle. The head section and the handle are pivotally connected with each other via a first and a second pivoted ends, whereby the handle can be up and down swung relative to the head section. The first and second pivoted ends respectively have a first and a second end faces facing each other. The first end face is formed with an upper and a lower contact sections. The second end face is formed with an upper and a lower abutment sections. The lower abutment section abuts against the lower contact section as a lower dead end of angular displacement of the handle. The upper abutment section abuts against the upper contact section as an upper dead end of angular displacement of the handle.

18 Claims, 11 Drawing Sheets

WRENCH WITH QUICKLY ANGULARLY ADJUSTABLE HANDLE

This application is a continuation application of application Ser. No. 14/160,341, entitled WRENCH WITH QUICKLY ANGULARLY ADJUSTABLE HANDLE, filed on Jan. 21, 2014.

BACKGROUND OF THE INVENTION

1. Field of the Invention

The present invention relates generally to a hand tool, and more particularly to a wrench having a head section and a handle. The handle can be swung relative to the head section within a fixed angular range.

2. Description of the Related Art

It is known that a wrench is a hand tool for wrenching a threaded member. A conventional wrench has a head section fixedly disposed at one end of the handle. The head section cannot be bent relative to the handle. In some operation sites, it often takes place that the wrenching path of the handle is interrupted by an obstacle. Therefore, the use of the wrench is limited and it is inconvenient to use the wrench.

Some improved wrenches of prior arts have been developed to overcome the above problem. The improved wrench has a head section and a handle, which can be swung relative to each other. The head section of such wrench is pivotally connected with one end of the handle and can be rotated. An angle adjustment mechanism is mounted between the handle and the head section for locating the head section in different angular positions. Accordingly, the angle contained between the handle and the head section can be adjusted according to the requirements of the operation sites. However, such wrench has a complicated structure and the head section and the handle of the wrench are located in a certain angular position by the angle adjustment mechanism. When it is necessary to change the angle contained between the handle and the head section, a user must operate the angle adjustment mechanism to adjust the angle contained between the handle and the head section. Therefore, the angle contained between the handle and the head section can be hardly quickly adjusted. In many operation sites, this will cause inconvenience in use of the wrench.

SUMMARY OF THE INVENTION

It is therefore a primary object of the present invention to provide a wrench having a head section and a handle. The handle can be swung relative to the head section within a fixed angular range, whereby the angle contained between the handle and the head section can be quickly adjusted.

To achieve the above and other objects, the wrench of the present invention includes a head section and a handle. The head section and the handle are pivotally connected with each other via a first pivoted end and a second pivoted end, whereby the handle can be up and down swung/angularly displaced relative to the head section. The first pivoted end and the second pivoted end respectively have a first end face and a second end face facing each other. The first end face has an upper section and a lower section. The upper section is formed with an upper contact section, while the lower section is formed with a lower contact section.

The second end face also has an upper section and a lower section. The upper section has an upper abutment section, while the lower section has a lower abutment section.

The lower abutment section of the second pivoted end abutting against the lower contact section of the first pivoted end serves as a lower dead end of angular displacement of the handle. The upper abutment section of the second pivoted end abutting against the upper contact section of the first pivoted end serves as an upper dead end of angular displacement of the handle.

Accordingly, the handle can be quickly angularly displaced relative to the head section within a fixed swing range between the upper and lower dead ends of the angular displacement travel of the handle. Therefore, a user can easily and quickly adjust the operation angle of the handle so as to avoid a raised object or an obstacle existing in the use environment of the wrench for further operating the wrench.

The upper and lower abutment sections or the upper and lower contact sections can be planes, keys or ribs.

The upper and lower abutment sections can be in face contact, linear contact or point contact with the corresponding upper and lower contact sections.

The present invention can be best understood through the following description and accompanying drawings, wherein:

DETAILED DESCRIPTION OF THE PREFERRED EMBODIMENTS

Figure 1:
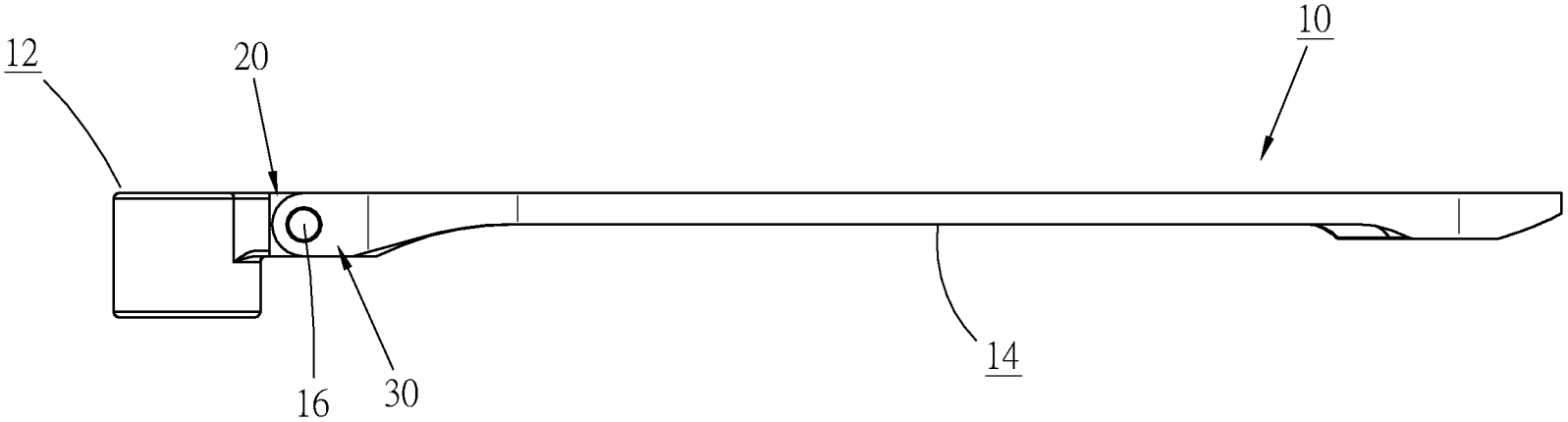
FIG. 1 is a front view of a first embodiment of the wrench of the present invention.
Figure 2:
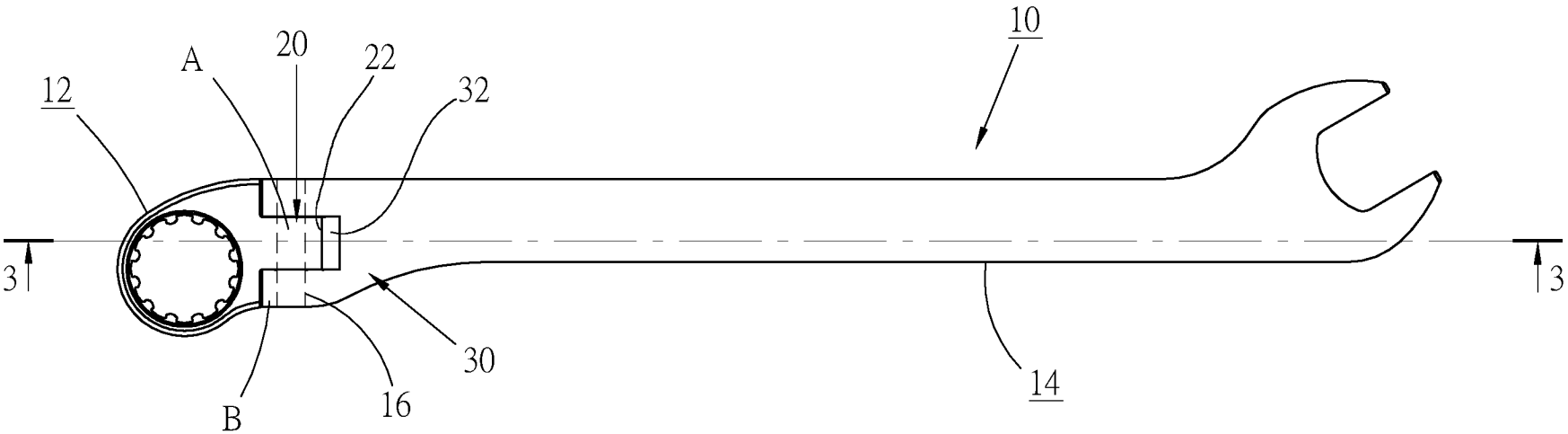
FIG. 2 is a top view according to FIG. 1.
Figure 3:
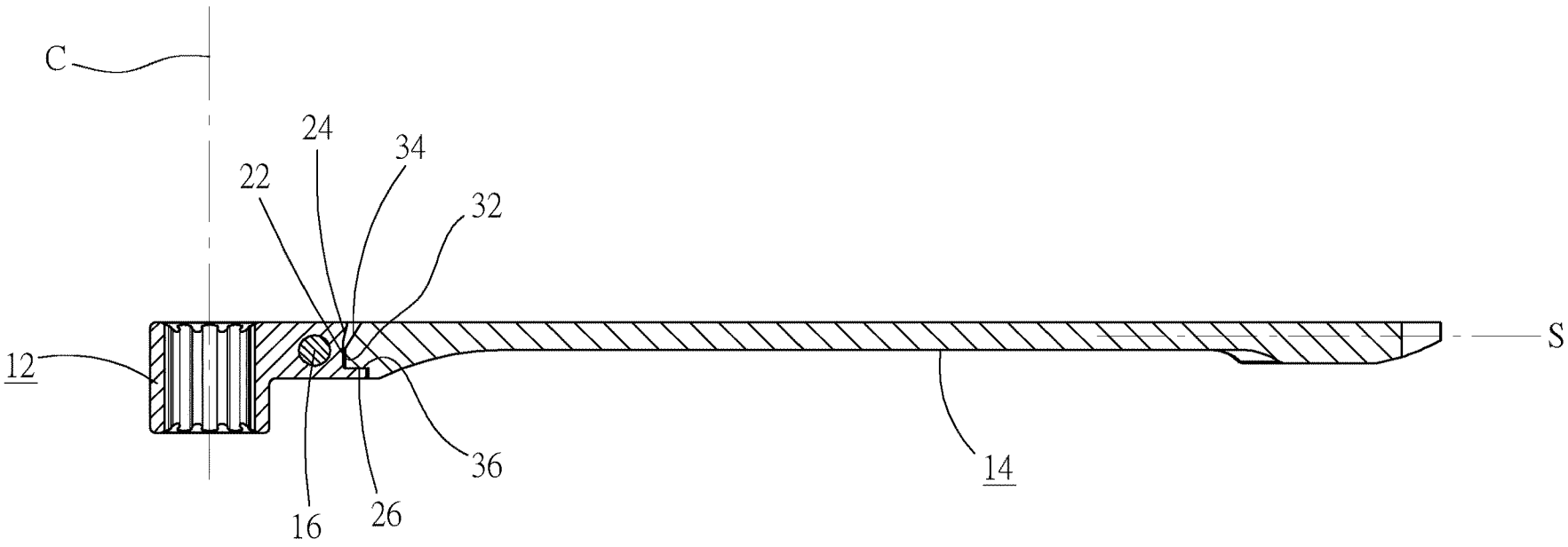
FIG. 3 is a sectional view taken along line 3-3 of FIG. 2, showing that the handle of the wrench is located at a lower dead end of angular displacement relative to the head section.

Please refer to FIGS. 1 to 3. According to a first embodiment, the wrench 10 of the present invention includes a head section 12 and a handle 14. The head section 12 and the handle 14 are pivotally connected with each other via a first pivoted end 20 and a second pivoted end 30 by means of a pivot pin 16. Accordingly, the head section 12 and the handle 14 can be rotated relative to each other.

In this embodiment, the first pivoted end 20 is a pivoted end of the head section 12, while the second pivoted end 30 is a pivoted end of the handle 14. The two pivoted ends can be switched so that the first pivoted end 20 is a pivoted end of the handle, while the second pivoted end is a pivoted end of the head section. The head section 12 has a drive end of the wrench for wrenching a threaded member (bolt or nut) or connecting with a socket. The handle 14 is up and down angularly moveable about the pin 16 relative to the head section 13. A longitudinal direction S of the handle is perpendicular to the axis of the pin. When a bolt or nut is located in the drive end of the head section, the drive end and the nut share a common axis. The rotational axis C of the drive end of the head section is perpendicular to an axis of the pin 16. The handle 14 rotates the drive end of the head section 12 about the rotational axis C of the drive end. The head section 12 can have different configurations without limitation to this embodiment. For example, the drive head can be an open end, a box end, a ratcheted structure or a socket of the wrench. The other end of the handle 14 can be made with a second head section of the wrench 10.

The first pivoted end 20 is a structure with one (or two) lugs A, while the second pivoted end 30 is a structure with two (or one) lug B. The lugs A, B are side by side positioned and pivotally connected by means of the pivot pin 16. In the longitudinal direction S of the wrench, the first pivoted end 20 and the second pivoted end 30 respectively have two end faces 22, 32 facing each other. The first end face 22 of the first pivoted end 20 is formed on an end face of the lug A, while the second end face 32 of the second pivoted end is formed between the two lugs B to right face the first end face 22. That is, the second end face 32 is formed on one side of one lug B.

Figure 4:
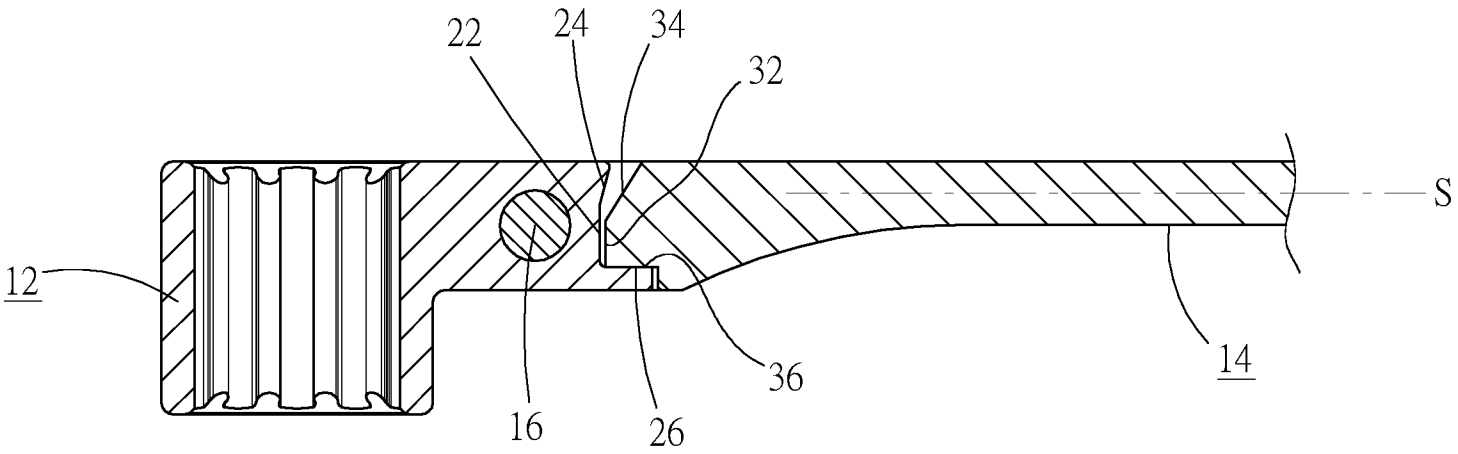
FIG. 4 is an enlarged view of a part of FIG. 3.
Figure 5:
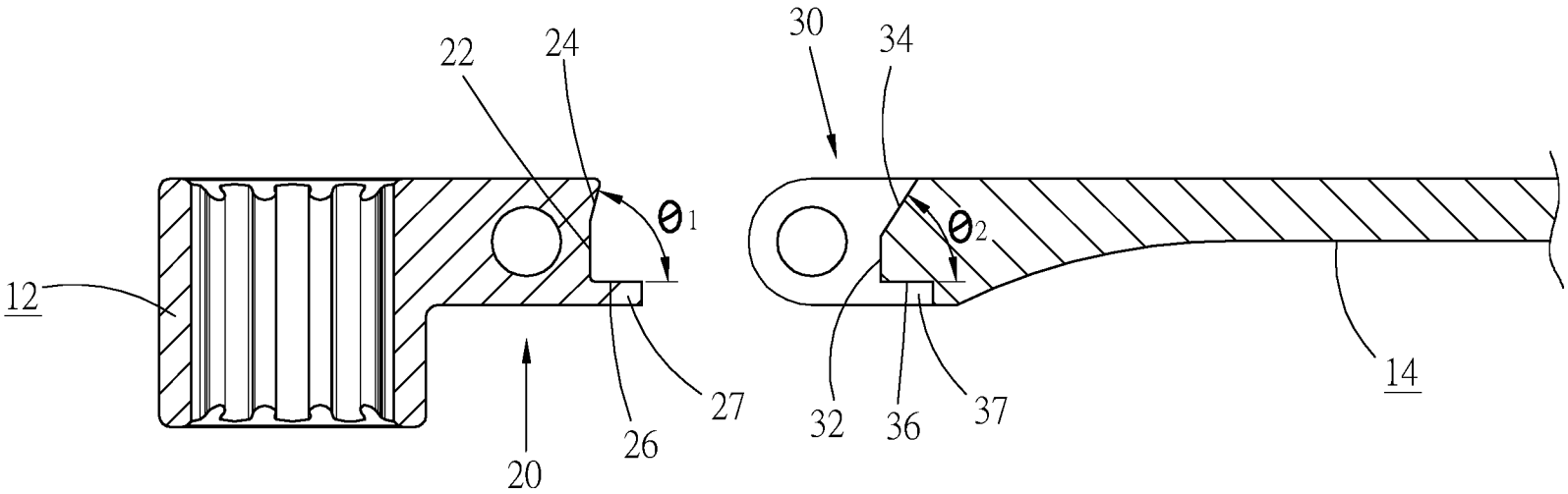
FIG. 5 is a sectional exploded view of the first embodiment of the wrench of the present invention.

Please refer to FIGS. 4 and 5. The first end face 22 of the first pivoted end 20 has an upper section and a lower section. The upper section is formed with an upper contact section 24, while the lower section is formed with a lower contact section 26. In the embodiment, the upper contact section and the lower contact section are spaced apart. The end face 32 of the second pivoted end 30 also has an upper section and a lower section. The upper section has an upper abutment section 34, while the lower section has a lower abutment section 36, the upper abutment section and the lower abutment section are spaced apart in the embodiment. The upper contact section 24 of the first pivoted end 20 is a slope inclined toward the second pivoted end 30. Therefore, the upper contact section 24 protrudes toward the second pivoted end 30. A lip section 27 is disposed on the lower section of the first end face 22 of the first pivoted end 20. The lip section 27 extends toward the second pivoted end 30. The lower contact section 26 is formed on a wall face of the lip section 27. For example, the lower contact section 26 can be formed on a top wall or a vertical wall of the lip section 27. A first angle θ1 is contained between the upper contact section 24 and the lower contact section 26. The upper abutment section 34 of the second pivoted end 30 is also a slope inclined away from the first pivoted end 20. That is, the upper abutment section 34 is disposed on the upper section of the second pivoted end 30 in a direction away from the first pivoted end 20. A recess 37 is formed under a bottom face of the lower section of the second end face 32. The lower abutment section 36 is formed on a wall face of the recess 37, for example, on a top wall or a vertical wall of the recess 37 corresponding to the lower contact section 26. A second angle θ2 is contained between the upper abutment section 34 and the lower abutment section 36. The second angle θ2 is smaller than the first angle θ1.

As aforesaid, the second angle θ2 is smaller than the first angle θ1. Therefore, after the two pivoted ends 20, 30 are pivotally connected with each other, the head section 12 and the handle 14 can be relatively swung around the pivot pin 16. In other words, according to the direction of FIG. 4, the second pivoted end 30, (that is, the handle 14) can be up and down swung relative to the first pivoted end 20, (that is, the head section 12). The swing travel/angular displacement travel of the second pivoted end 30 is limited to a swing range defined by the upper and lower contact sections 24, 26. The swing plane of the handle 14 is perpendicular to the axial direction of the pivot pin 16.

Please refer to FIG. 4. In normal state, no matter whether a user holds the handle 14 or the head section 12, the lower contact section 26 of the first pivoted end 20 abuts against the lower abutment section 36 of the second pivoted end 30 as a lower dead end of the angular displacement travel of the handle 14. At this time, the upper contact section 24 is not in contact with the upper abutment section 34, whereby there is a room for the handle 14 to upward swing/angularly displace.

Figure 6:
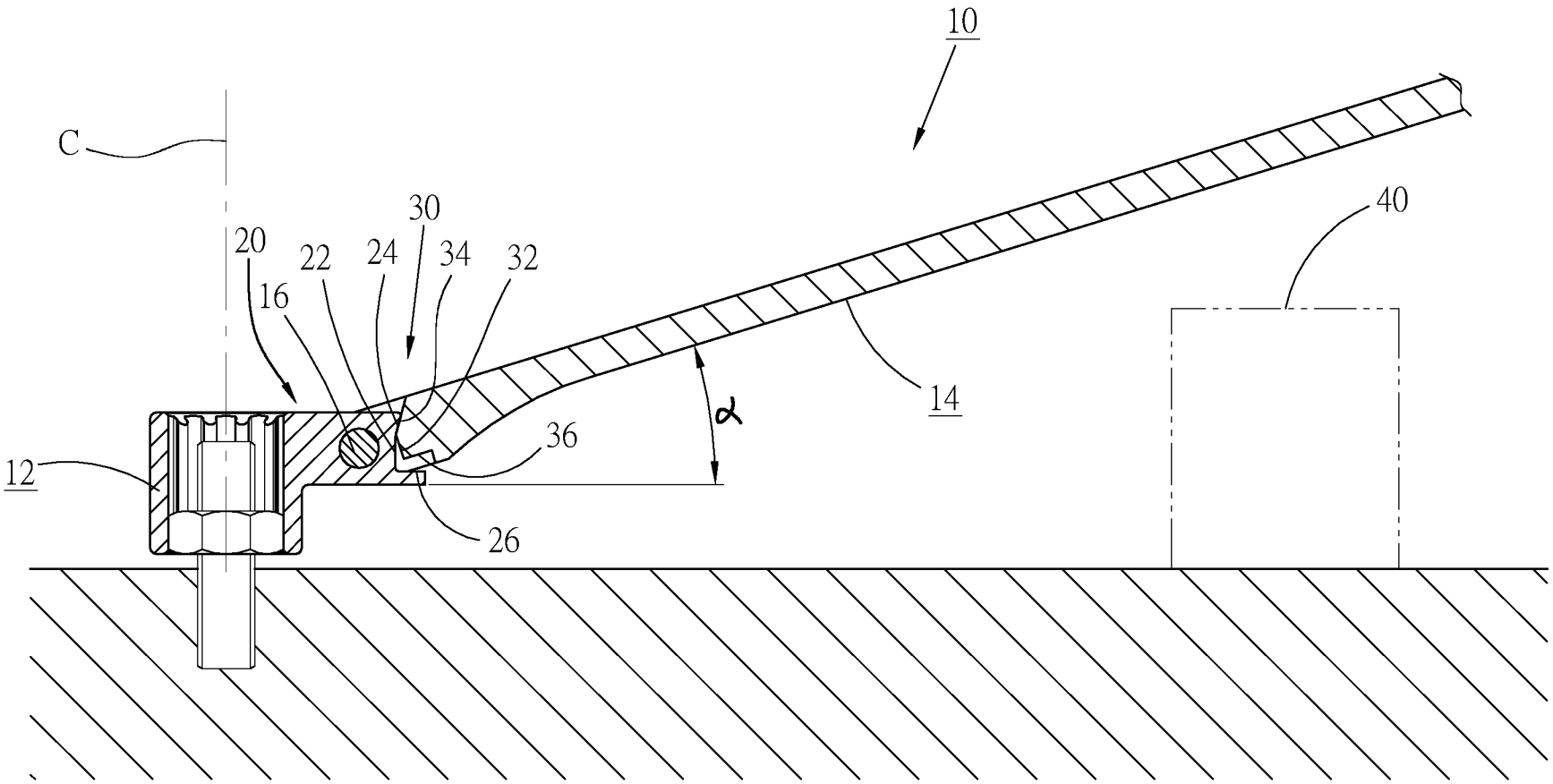
FIG. 6 is a sectional view of the first embodiment of the wrench of the present invention, showing that the handle of the wrench is located at an upper dead end of angular displacement relative to the head section.

In use, the head section 12 is fitted onto a threaded member and the user holds the handle 14 of the wrench 10 to wrench the threaded member. As shown in FIG. 6, in the case that a raised object 40 exists in the operation environment to interrupt the wrenching path of the handle 14, the user can lift the handle 14 to a position higher than the raised object 40 so as to avoid the raised object. Accordingly, the user can further operate the wrench 10. When the upper abutment section 36 of the second pivoted end 30 touches the upper contact section 26 of the first pivoted end 20, the handle 14 cannot be further upward angularly displaced. It is therefore serving as an upper dead end of the angular displacement travel of the handle 14. After the handle 14 passes over the raised object 40, the handle 14 can be restored to the lower dead end for further wrenching operation as shown in FIG. 4.

The handle 14 of the wrench can be quickly swung/angularly displaced relative to the head section 12. The swing angle α of FIG. 6 is the swing range of the handle 14 between the upper and lower dead ends. The user can quickly change the angular position of the handle 14 within the swing range of the fixed swing angle α as shown in FIG. 6. After the head section 12 is fitted onto the threaded member, the user only needs to lift or lower the handle 14 to easily adjust the operation angle of the handle.

Figure 7:
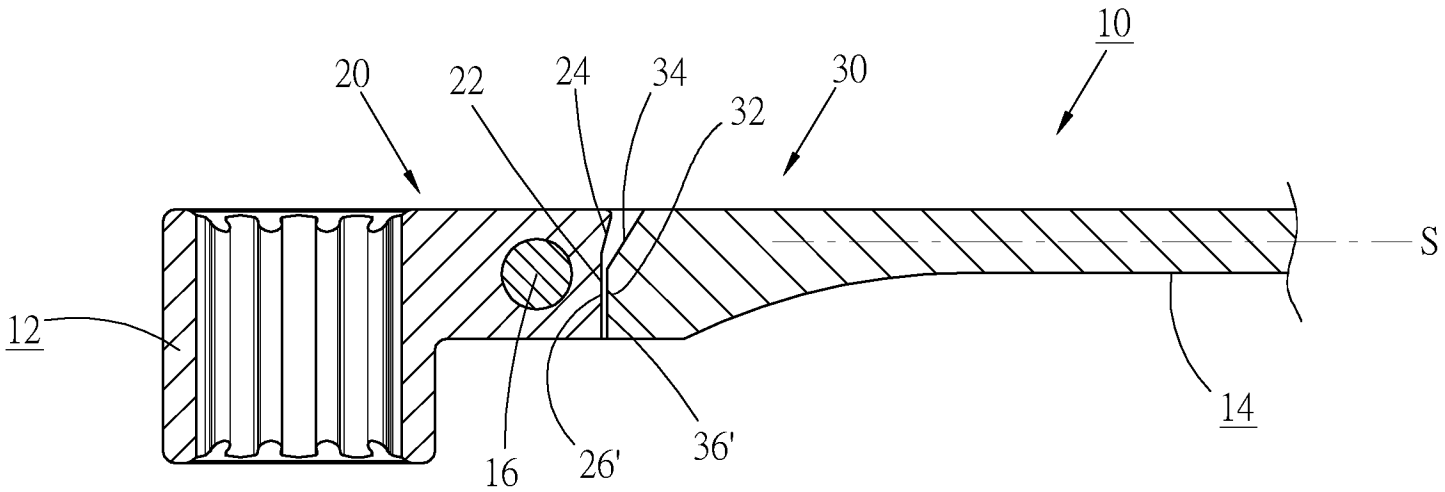
FIG. 7 is a longitudinal sectional view of a second embodiment of the wrench of the present invention.
Figure 8:
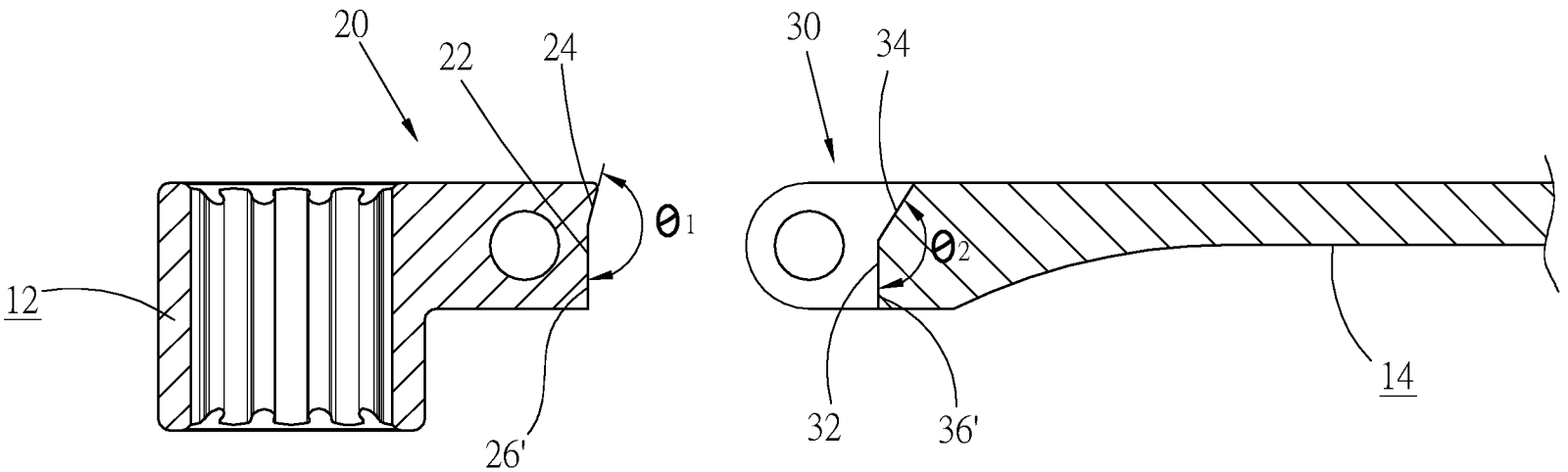
FIG. 8 is a sectional exploded view according to FIG. 7.

FIGS. 7 and 8 show a second embodiment of the wrench 10 of the present invention, wherein the same components are denoted with the same reference numerals as the first embodiment. The head section 12 and the handle 14 of the wrench 10 are pivotally connected with each other via a first pivoted end 20 and a second pivoted end 30, whereby the head section 12 and the handle 14 can be rotated relative to each other.

The upper and lower sections of the first end face 22 of the first pivoted end 20 are similarly formed with an upper contact section 24 and a lower contact section 26'. The upper and lower sections of the second end face 32 of the second pivoted end 30 are formed with an upper abutment section 34 and a lower abutment section 36'. In this embodiment, the upper contact section 24 and the upper abutment section 34 are both slopes identical to that of the first embodiment. The lower contact section 26' and the lower abutment section 36' are planes perpendicular to the longitudinal direction S of the wrench. The first angle θ1 contained between the upper and lower contact sections 24, 26' is larger than the second angle θ2 contained between the upper and lower abutment sections 34, 36'. The second angle θ2 is smaller than the first angle θ1.

Figure 9:
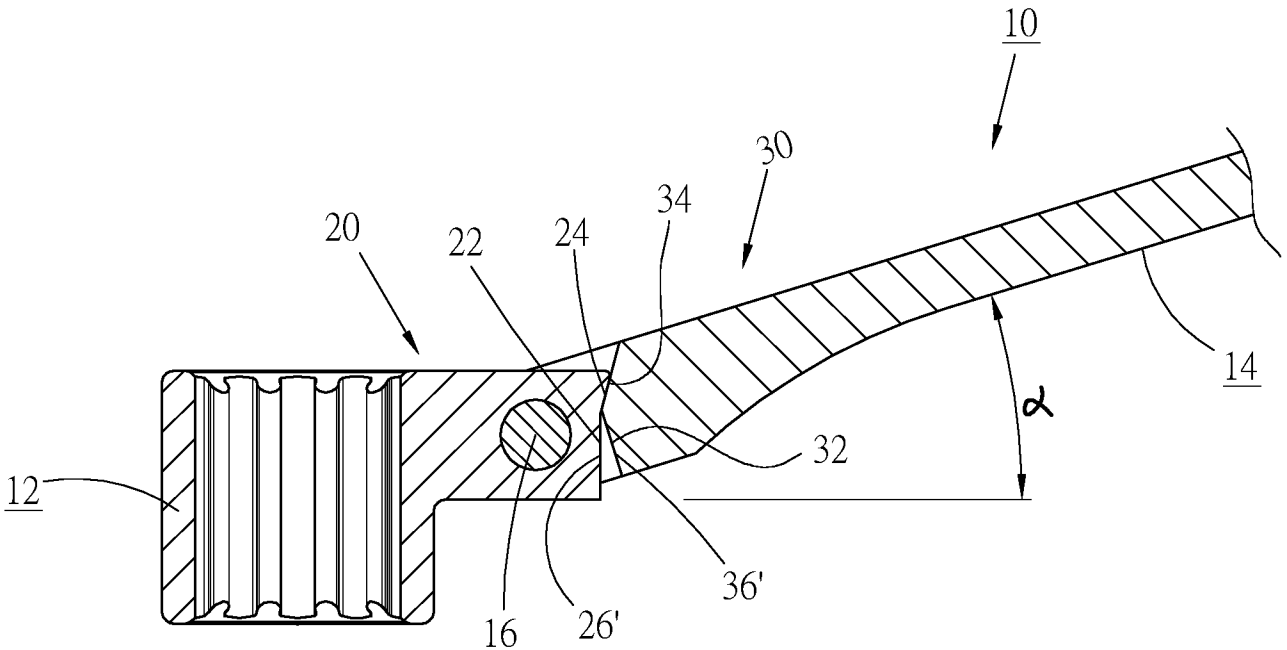
FIG. 9 is a sectional view according to FIG. 7, showing that the handle of the wrench is located at an upper dead end of angular displacement relative to the head section.

The lower abutment section 36' of the second pivoted end 30 abuts against the lower contact section 26' of the first pivoted end 20 as a lower dead end of the angular displacement travel of the handle 14 as shown in FIG. 7. The handle 14 can be lifted to make the upper abutment section 34 of the second pivoted end 30 contact the upper contact section 24 of the first pivoted end 20 as an upper dead end of the angular displacement travel of the handle 14 as shown in FIG. 9. Accordingly, the handle 14 can be quickly swung between the upper and lower dead ends.

Figure 10:
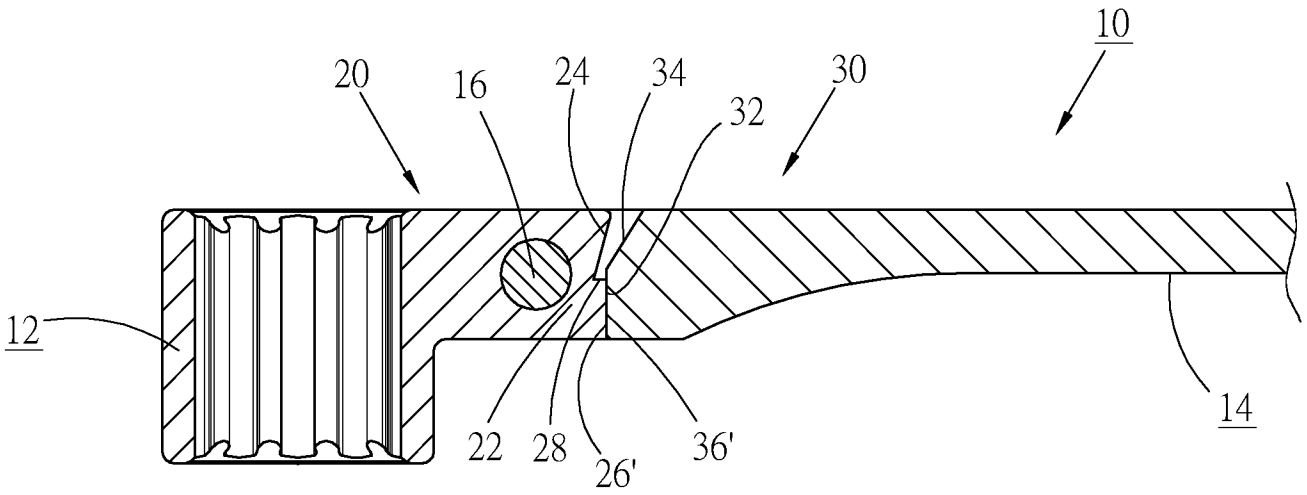
FIG. 10 is a longitudinal sectional view of a third embodiment of the wrench of the present invention.

FIG. 10 shows a third embodiment of the wrench 10 of the present invention, wherein the same components are denoted with the same reference numerals and will not be repeatedly described hereinafter. The third embodiment is similar to the second embodiment of the wrench. In the third embodiment, a stepped section 28 is formed and protrudes from the lower section of the first end face 22 of the first pivoted end 20, the stepped section 28 is more protruding outwardly than the bottom of the upper contact section 24. The lower contact section 26' is formed on a straight wall of the stepped section 28 facing the lower abutment section 36' of the second end face 32. Alternatively, a stepped section protrudes from the second end face 32 of the second pivoted end 30 and the lower abutment section 36' is formed on a straight wall of the stepped section facing the lower contact section of the first end face, and the stepped section is more protruding outwardly than the bottom of the upper abutment section.

Figure 11:
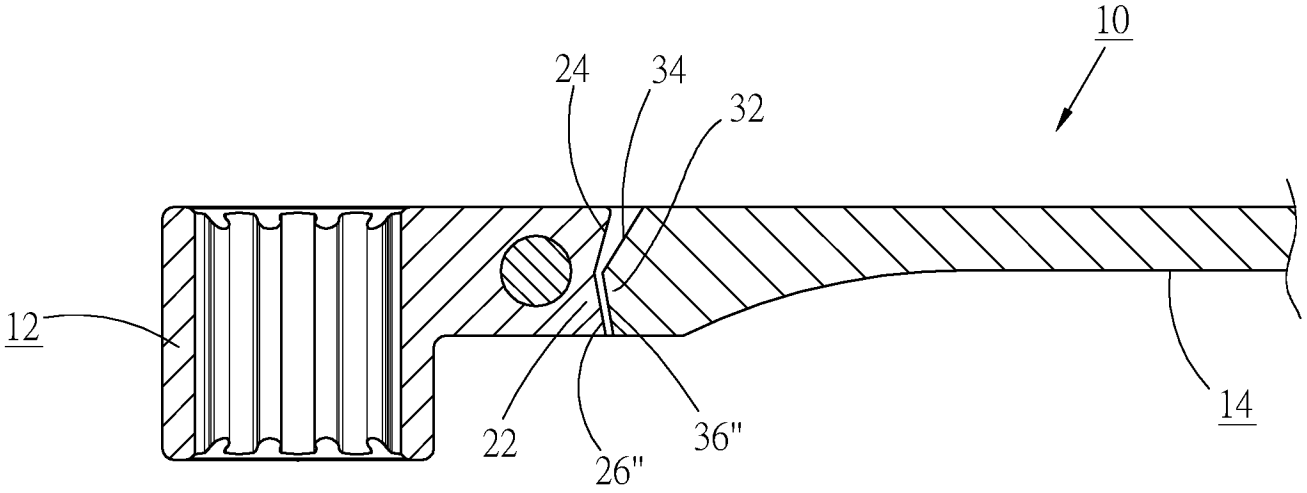
FIG. 11 is a longitudinal sectional view of a fourth embodiment of the wrench of the present invention.

FIG. 11 shows a fourth embodiment of the wrench of the present invention, wherein the same components are denoted with the same reference numerals. In the fourth embodiment, the lower contact section 26" and the lower abutment section 36" of the wrench 10 are slopes, which are not limited to planes perpendicular to the longitudinal direction of the wrench. Therefore, in this embodiment, the upper and lower contact sections 24, 26" and the upper and lower abutment sections 34, 36" are all slopes to serve as the upper and lower dead ends of the swing of the handle 14.

Figure 12:
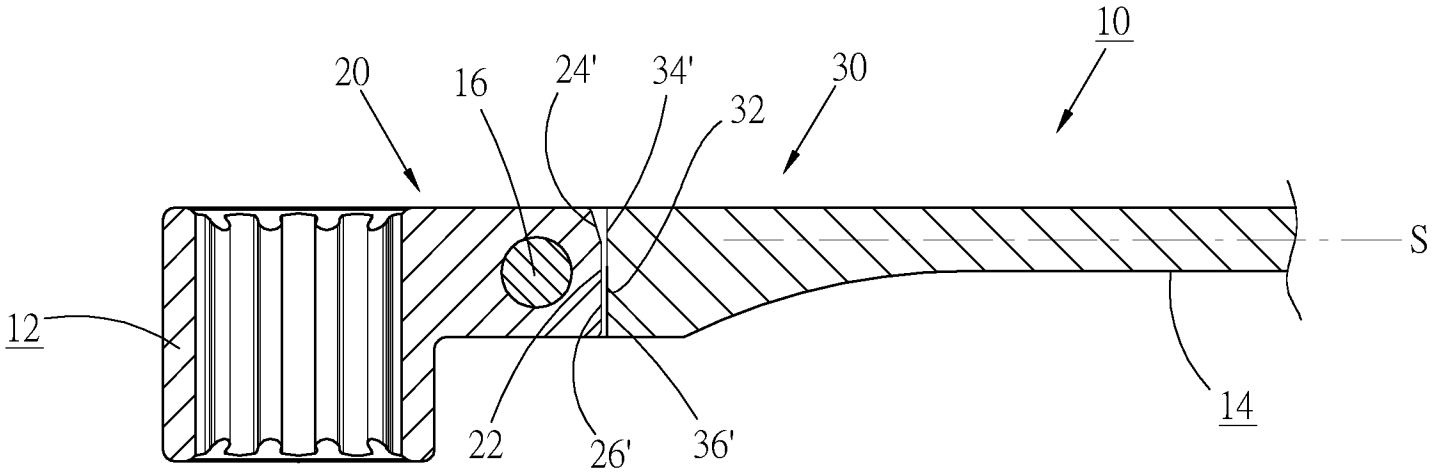
FIG. 12 is a longitudinal sectional view of a fifth embodiment of the wrench of the present invention, showing that the handle of the wrench is located at an upper dead end of angular displacement relative to the head section.
Figure 13:
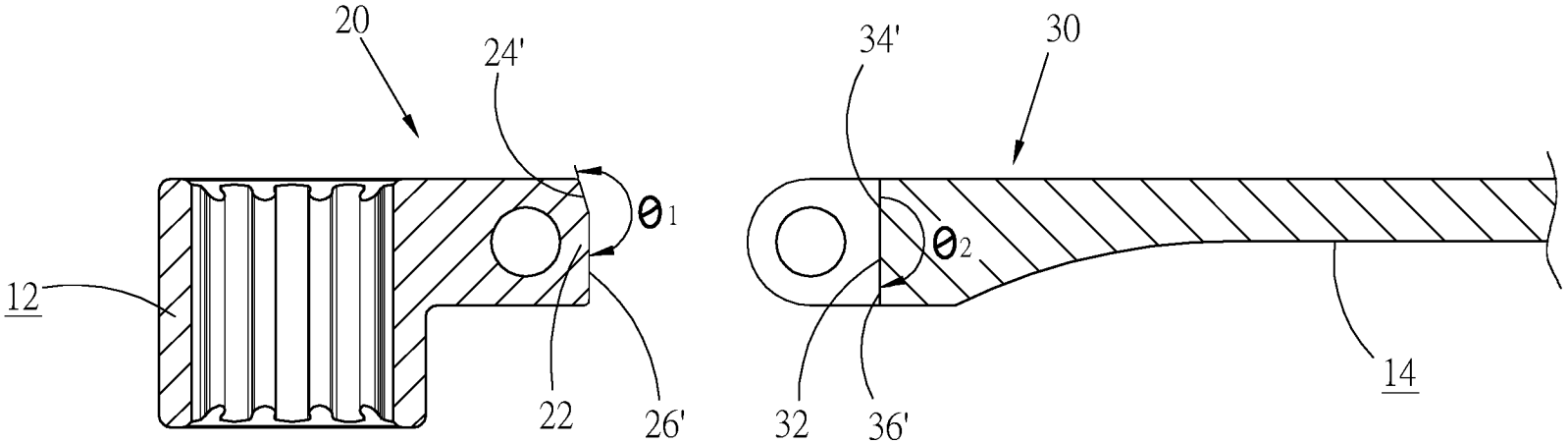
FIG. 13 is a sectional exploded view according to FIG. 12.
Figure 14:
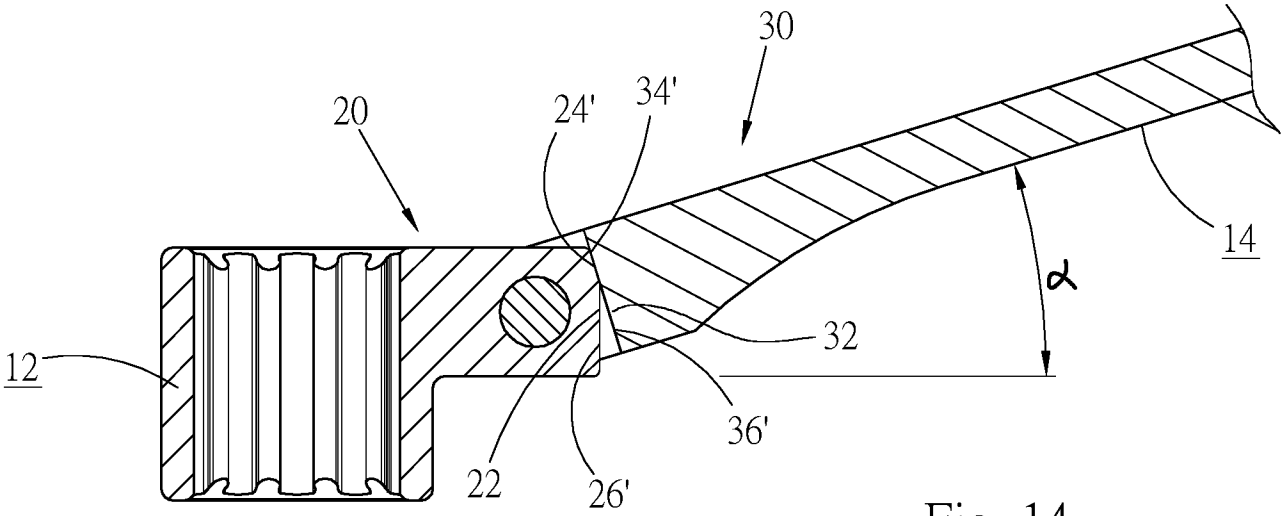
FIG. 14 is a longitudinal sectional view of the fifth embodiment of the wrench of the present invention, showing that the handle of the wrench is located at a lower dead end of angular displacement relative to the head section.

FIGS. 12 to 14 show a fifth embodiment of the wrench 10 of the present invention, wherein the same components are denoted with the same reference numerals. In the fifth embodiment, the lower contact section 26' of the first pivoted end 20 and the lower abutment section 36' of the second pivoted end 30 are planes perpendicular to the longitudinal direction S of the wrench as in the second embodiment. The upper contact section 24' of the first pivoted end 20 is a slope inclined away from the second pivoted end 30. The upper abutment section 34' of the second pivoted end 30 is also a plane perpendicular to the longitudinal direction S of the wrench. The upper and lower abutment sections 34', 36' can be coplanar. Identically, the first angle θ1 contained between the upper and lower contact sections 24', 26' is larger than the second angle θ2 contained between the upper and lower abutment sections 34', 36'. When the lower abutment sections 36' of the second pivoted end 30 contacts the lower contact section 24' of the first pivoted end 20, the handle 14 is located at the lower dead end as shown in FIG. 12. When the handle 14 is lifted to make the upper abutment section 34' contact the upper contact section 24', the handle 14 is located at the upper dead end as shown in FIG. 14.

Figure 15:
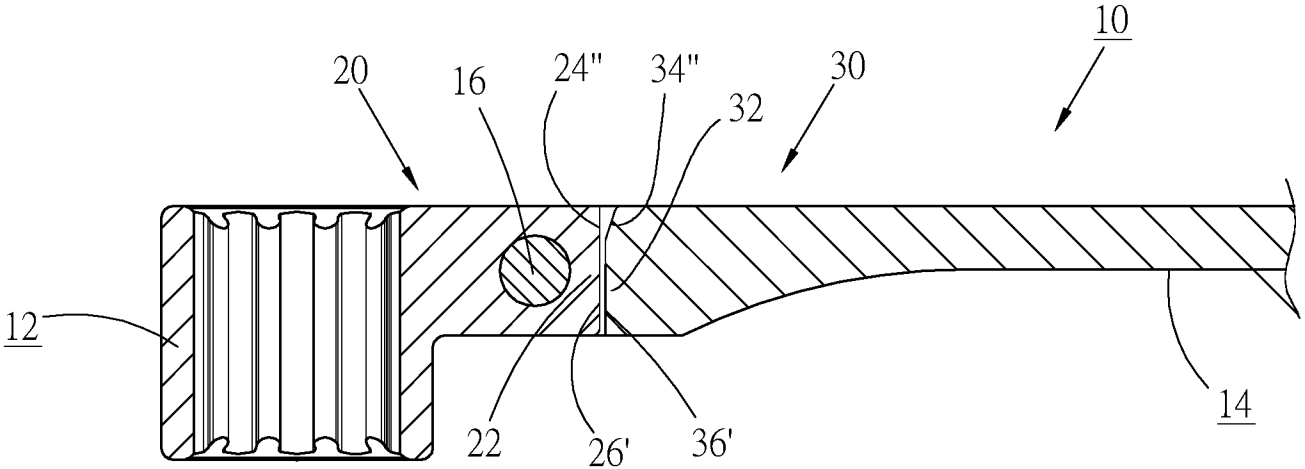
FIG. 15 is a longitudinal sectional view of a sixth embodiment of the wrench of the present invention.

FIG. 15 shows a sixth embodiment of the wrench of the present invention. In the sixth embodiment, the upper contact section 24" and the lower contact section 26" of the first pivoted end 20 are both plane contact faces (planes or slopes) and coplanar. The lower abutment section 36' of the second pivoted end 30 is a plane perpendicular to the longitudinal direction of the wrench. The upper abutment section 34" is a slope inclined away from the first pivoted end 20. The first angle contained between the upper and lower contact sections 24", 26' is larger than the second angle contained between the upper and lower abutment sections 34", 36'. Similarly, the handle 14 can be up and down swung/angularly displaced relative to the head section 12 within the fixed swing range between the upper and lower dead ends.

Figure 16:
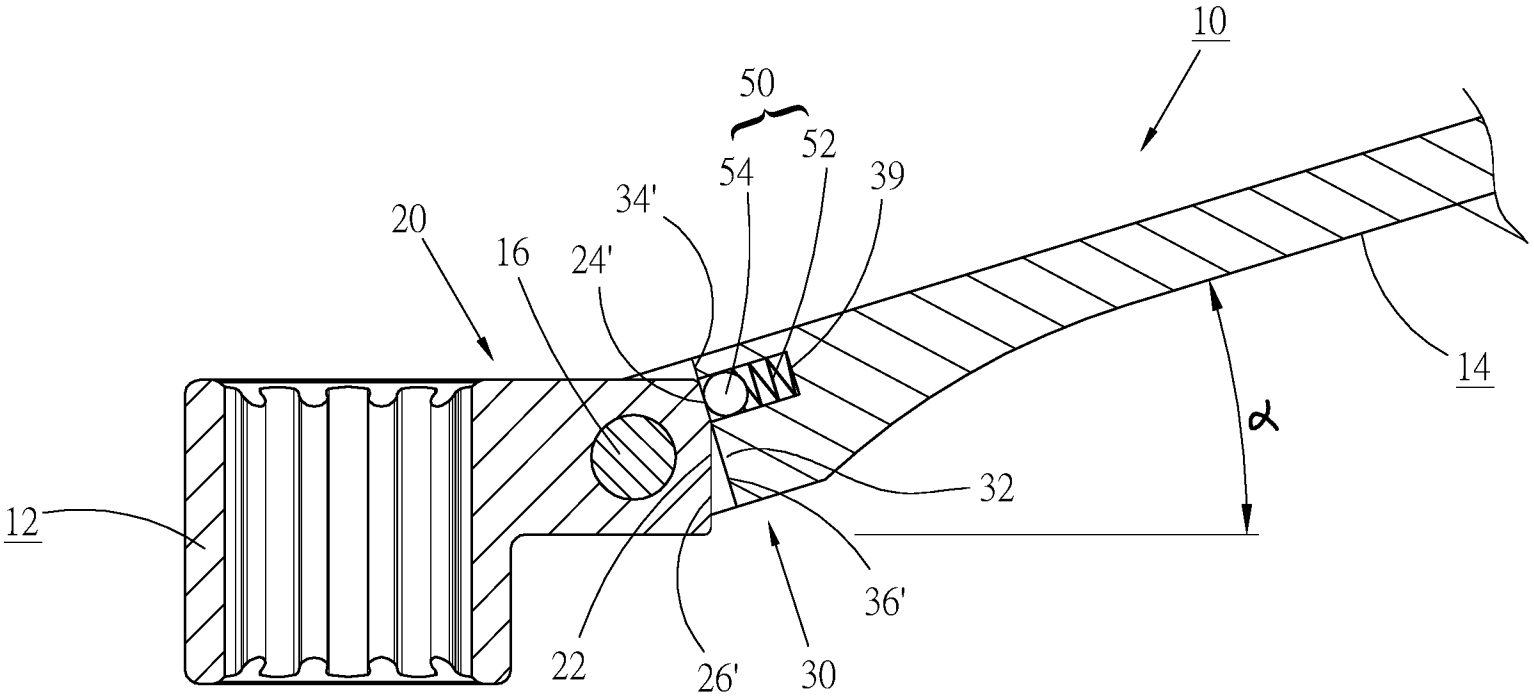
FIG. 16 is a longitudinal sectional view of a seventh embodiment of the wrench of the present invention.

FIG. 16 shows a seventh embodiment of the wrench of the present invention. The seventh embodiment of the wrench 10 is based on the fifth embodiment of the wrench as shown in FIG. 12. The seventh embodiment further includes an elastic assembly 50 mounted on the upper contact section 24' or the upper abutment section 34'. In the case that the elastic assembly 50 is mounted on the upper abutment section 34', the upper abutment section 34' is formed with a socket 39. The elastic assembly 50 includes an elastic member 52 and a push member 54 mounted in the socket 39. The push member 54 is pushed by the elastic member 52 to partially protrude from the upper abutment section 34'. The handle 14 can be up and down swung. When the handle 14 reaches the upper dead end, the push member 54 elastically contacts the upper contact section 24', whereby the handle 14 is positioned at the upper dead end. The elastic assembly 50 of this embodiment is applicable to any of the above embodiments to locate the handle at the upper dead end.

Figure 17:
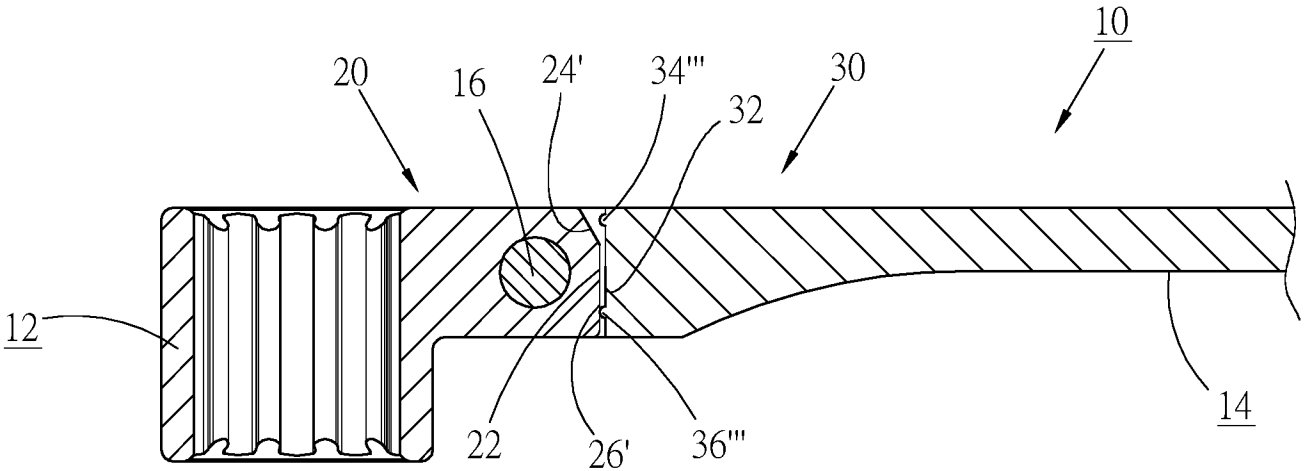
FIG. 17 is a longitudinal sectional view of an eighth embodiment of the wrench of the present invention.

The upper dead end and lower dead end of the handle are not limited to the form of face contact. Alternatively, the upper dead end and lower dead end of the handle can have the form of linear contact or point contact. FIG. 17 shows an eighth embodiment of the present invention. In this embodiment, the upper abutment section 34" or the lower abutment section 36" of the wrench 10 has the form of a key or a rib. The upper and lower abutment sections can be coplanar or non-coplanar. Similarly, the upper contact section or lower contact section of the first end face 22 also can be a key or a rib. In this case, when the handle 14 reaches the upper or lower dead end, the two pivoted ends 20, 30 are in point contact, linear contact or face contact with each other.

In addition, even if the respective abutment sections or contact sections are planes or slopes, the abutment sections can be also in face contact or linear contact with the corresponding contact sections.

The wrench of the present invention is free from the angle adjustment mechanism of the conventional wrench. The handle of the wrench of the present invention can be swung within the swing range between the upper and lower dead ends. In the case that an obstacle exists in the wrenching path of the wrench, a user only needs to lift the handle to avoid the obstacle for further operating the wrench. After the handle passes over the obstacle, the handle is moved to the lower dead end and restored to its home position. Accordingly, the operation angle of the handle of the wrench of the present invention can be easily and quickly adjusted according to the requirements of operation site so that the wrench can be conveniently used.

The above embodiments are only used to illustrate the present invention, not intended to limit the scope thereof. Many modifications of the above embodiments can be made without departing from the spirit of the present invention.

What is claimed is:

1. A wrench with quickly angularly adjustable handle, comprising:

a head section and a handle, the head section and the handle being pivotally connected with each other via a pin inserted in a first pivoted end and a second pivoted end, the head section has a drive end and the first pivoted end, the drive end and the first pivoted end are located on opposing ends of the head section, the handle is up and down angularly moveable about the pin relative to the head section, a longitudinal direction of the handle is perpendicular to the axis of the pin and a rotational axis of the drive end of the head section is perpendicular to an axis of the pin, the handle rotates the drive end of the head section about the rotational axis of the drive end, in a longitudinal direction of the wrench, the first pivoted end and the second pivoted end respectively having a first end face and a second end face facing each other, wherein:

the first end face of the first pivoted end having an upper section and a lower section, the upper section being formed with an upper contact section, while the lower section being formed with a lower contact section; a first angle being contained between the upper contact section and the lower contact section;

the second end face of the second pivoted end also having an upper section and a lower section, the upper section having an upper abutment section, while the lower section having a lower abutment section; a second angle being contained between the upper abutment section and the lower abutment section, the first angle being larger than the second angle;

wherein when the lower abutment section of the second pivoted end abutting against the lower contact section of the first pivoted end, the lower abutment section and the lower contact section serving as a lower dead end of angular displacement of the handle and, when the upper abutment section of the second pivoted end abutting against the upper contact section of the first pivoted end, the upper abutment section and the upper contact section serving as an upper dead end of angular displacement of the handle;

a lip section is disposed on the lower section of the first end face to extend toward the second pivoted end, the lower contact section being formed on a wall face of the lip section; and a recess is formed on the lower section of the second end face, the lower abutment section being formed on a wall face of the recess corresponding to the lower contact section.

2. The wrench as claimed in claim 1, wherein the lower contact section is formed on a top wall of the lip section and the lower abutment section is formed on a top wall of the recess.

3. The wrench as claimed in claim 1, wherein the upper contact section and the upper abutment section are slopes.

4. The wrench as claimed in claim 1, wherein the upper contact section or the upper abutment section is a slope.

5. The wrench as claimed in claim 1, wherein the upper contact section of the first end face is disposed on the first end face in a direction away from the second pivoted end.

6. The wrench as claimed in claim 1, wherein the upper abutment section of the second end face is disposed on the second end face in a direction away from the first pivoted end.

7. The wrench as claimed in claim 1, further comprising an elastic assembly disposed on the upper contact section or the upper abutment section; when the handle is located at the upper dead end, the upper contact section and the upper abutment section elastically contacting each other via the elastic assembly.

8. The wrench as claimed in claim 1, wherein the first pivoted end is a structure with at least one lug, the first end face being formed on an end face of the lug, the second pivoted end being a structure with at least one lug, the second end face being formed on one side of the at least one lug, the two pivoted ends being pivotally connected with each other by means of the pivot pin.

9. A wrench with quickly angularly adjustable handle, comprising:

a head section and a handle, the head section and the handle being pivotally connected with each other via a pin inserted in a first pivoted end and a second pivoted end, the head section has a drive end and the first pivoted end, the drive end and the first pivoted end are located on opposing ends of the head section, the handle is up and down angularly moveable about the pin relative to the head section, a longitudinal direction of the handle is perpendicular to the axis of the pin and a rotational axis of the drive end of the head section is perpendicular to an axis of the pin, the handle rotates the drive end of the head section about the rotational axis of the drive end, in a longitudinal direction of the wrench, the first pivoted end and the second pivoted end respectively having a first end face and a second end face facing each other, wherein:

the first end face of the first pivoted end having an upper section and a lower section, the upper section being formed with an upper contact section, while the lower section being formed with a lower contact section; a first angle being contained between the upper contact section and the lower contact section;

the second end face of the second pivoted end also having an upper section and a lower section, the upper section having an upper abutment section, while the lower section having a lower abutment section; a second angle being contained between the upper abutment section and the lower abutment section, the first angle being larger than the second angle;

wherein when the lower abutment section of the second pivoted end abutting against the lower contact section of the first pivoted end, the lower abutment section and the lower contact section serving as a lower dead end of angular displacement of the handle and, when the upper abutment section of the second pivoted end abutting against the upper contact section of the first pivoted end, the upper abutment section and the upper contact section serving as an upper dead end of angular displacement of the handle; and a stepped section is formed and protrudes from the lower section of the first end face; the lower contact section is formed on a wall of the stepped section facing the lower abutment section of the second end face.

10. The wrench as claimed in claim 9, wherein the stepped section is more protruding outwardly than the bottom of the upper contact section.

11. The wrench as claimed in claim 9, wherein the upper contact section and the upper abutment section are slopes.

12. The wrench as claimed in claim 9, wherein the upper contact section or the upper abutment section is a slope.

13. The wrench as claimed in claim 9, wherein the upper contact section of the first end face is disposed on the first end face in a direction away from the second pivoted end.

14. The wrench as claimed in claim 9, wherein the upper abutment section of the second end face is disposed on the second end face in a direction away from the first pivoted end.

15. The wrench as claimed in claim 9, further comprising an elastic assembly disposed on the upper contact section or the upper abutment section; when the handle is located at the upper dead end, the upper contact section and the upper abutment section elastically contacting each other via the elastic assembly.

16. The wrench as claimed in claim 9, wherein the first pivoted end is a structure with at least one lug, the first end face being formed on an end face of the lug, the second pivoted end being a structure with at least one lug, the second end face being formed on one side of the at least one lug, the two pivoted ends being pivotally connected with each other by means of the pivot pin.

17. A wrench with quickly angularly adjustable handle, comprising:

a head section and a handle, the head section and the handle being pivotally connected with each other via a pin inserted in a first pivoted end and a second pivoted end, the head section has a drive end and the first pivoted end, the drive end and the first pivoted end are located on opposing ends of the head section, the handle is up and down angularly moveable about the pin relative to the head section, a longitudinal direction of the handle is perpendicular to the axis of the pin and a rotational axis of the drive end of the head section is perpendicular to an axis of the pin, the handle rotates the drive end of the head section about the rotational axis of the drive end, in a longitudinal direction of the wrench, the first pivoted end and the second pivoted end respectively having a first end face and a second end face facing each other, wherein:

the first end face of the first pivoted end having an upper section and a lower section, the upper section being formed with an upper contact section, while the lower section being formed with a lower contact section; a first angle being contained between the upper contact section and the lower contact section;

the second end face of the second pivoted end also having an upper section and a lower section, the upper section having an upper abutment section, while the lower section having a lower abutment section; a second angle being contained between the upper abutment section and the lower abutment section, the first angle being larger than the second angle;

wherein when the lower abutment section of the second pivoted end abutting against the lower contact section of the first pivoted end, the lower abutment section and the lower contact section serving as a lower dead end of angular displacement of the handle and, when the upper abutment section of the second pivoted end abutting against the upper contact section of the first pivoted end, the upper abutment section and the upper contact section serving as an upper dead end of angular displacement of the handle; and a stepped section is formed and protrudes from the lower section of the second end face; the lower abutment section is formed on a wall of the stepped section facing the lower contact section of the first end face.

18. The wrench as claimed in claim 17, wherein the stepped section is more protruding outwardly than the bottom of the upper abutment section.

* * * * *